US005435548A

United States Patent [19]

Leduke et al.

[11] Patent Number: 5,435,548

[45] Date of Patent: Jul. 25, 1995

[54] HOCKEY STICK BLADE

[76] Inventors: Larry Leduke, 6424 10th Line West, Mississauga, Ontario, Canada, L5N 5T4; Gary Green, 1605 SW. 20th Ave., Boca Raton, Fla. 33486

[21] Appl. No.: 207,562

[22] Filed: Mar. 7, 1994

[51] Int. Cl.[6] ..... A63B 59/12

[52] U.S. Cl. ..... 273/67 A; 273/129 K

[58] Field of Search ..... 273/178, 173, 67 A, 273/67 DC, 57.2, 67 A, 67 DC

[56] References Cited

U.S. PATENT DOCUMENTS

| | | | |
|---|---|---|---|
| 2,912,245 | 2/1957 | Gardner et al. . | |
| 3,851,880 | 12/1974 | Ritch | 273/67 A |
| 4,124,208 | 11/1978 | Burns | 273/67 A |
| 4,452,451 | 6/1984 | Dubreuil . | |
| 4,570,932 | 2/1986 | Cote . | |
| 4,635,941 | 1/1987 | Yoneyama | 273/78 |
| 4,651,990 | 3/1987 | Profit . | |
| 5,127,649 | 7/1992 | Carboneno | 273/67 A |

FOREIGN PATENT DOCUMENTS

| | | | |
|---|---|---|---|
| 459578 | 9/1949 | Canada | 273/67 A |
| 698375 | 11/1964 | Canada | 273/67 A |
| 1207350 | 7/1986 | Canada | 273/67 A |
| 8203789 | 11/1982 | WIPO | 273/67 A |

*Primary Examiner*—Theatrice Brown

*Attorney, Agent, or Firm*—Malin, Haley, Dimaggio & Crosby

[57] ABSTRACT

A hockey stick blade including a flexible, resilient, polyurethane foam pad permanently adhered to the upper corner of the front edge of a hockey stick blade such that the striking surface is unobstructed and the weight and dimensions of the blade are unaltered, wherein the pad has properties which cause it to interlock with the pores of the blade. A recession or cutout may be defined by the upper corner to which the pad is adhered for a more resilient pad and enhanced attachment.

11 Claims, 1 Drawing Sheet

HOCKEY STICK BLADE

BACKGROUND OF THE INVENTION

1. Field of the Invention

This invention relates generally to an improved hockey stick blade, and, more particularly, relates to a blade for a hockey stick which employs a novel flexible foam tip to reduce the risk of stick-related injuries.

2. Description of the Prior Art

Hockey sticks, today and in the past, are well known for causing a significant number of eye injuries and skin lacerations. While hockey is known for being a very physical sport, many such injuries are inadvertently caused when the tip of the stick blade contacts another player. The conventional hockey stick has a rigid blade with sharp corners at the front or toe end of the blade. The upper tip or corner of the toe is the leading edge of the blade and consequently accounts for most of these injuries. Accordingly, a softer and more resilient tip would substantially reduce the number and severity of eye injuries and face lacerations sustained in the sport and would be highly welcomed at all levels of hockey from pee wee to professional.

Several devices are contemplated in the background art for improving hockey sticks. However, they have received little acceptance. Such devices typically involve cumbersome attachments or alterations that change the blade's dimensions and/or puck handling characteristics or which violate strict dimensional requirements imposed by various sanctioning bodies. For example, Cote, U.S. Pat. No. 4,570,932, teaches a hockey stick having a wedge inserted between laminations at the end of the blade so that the front surface of the blade is curved and the rear surface is straight. Not only is the Cote blade unduly expensive to manufacture, such a configuration weakens the rigidity of the blade and undoubtedly has a marked effect on its handling characteristics. Dubreuil, U.S. Pat. No. 4,452,451, discloses a hockey stick blade pad which is made from a semi-rigid material and covers the entire toe end of the blade from the top edge to the bottom edge. This arrangement is likewise undesirable because the pad material interferes with stick handling, tip-ins and the like. De Meza, Canadian Patent 698,375, discloses a hockey stick blade tip fabricated from a foamed rubber or plastic that is taped or glued to the top portion of the hockey stick blade. This structure is also unwelcomed in that the shield is not adequately affixed to the blade for preventing dislodgement during play and the material used is subject to hardening under cold, wet conditions. Another protective blade covering is disclosed by Gardner in U.S. Pat. No. 2,912,245, and it comprises a sleeve attachment for reinforcing the blade which covers the entire blade. Other hockey blade sleeves are disclosed by Profit in U.S. Pat. No. 4,651,990 and by Carbonero in U.S. Pat. No. 5,127,649. By way of contrast, the present invention employs a state of the art, lightweight, water-resistant, polyurethane foam that is permanently adhered to only the tip of the blade without requiring adhesives or altering the physical dimensions of the useful portions of the blade or interfering with its use.

The above noted background art neither solves nor addresses the problems contemplated by the present invention. There remains a need for a significant improvement in the hockey stick to reduce the incidence of serious eye injuries and face lacerations that occur with conventional blade design, without interfering with the player's performance. The present invention solves these problems by improving the tip of the blade while maintaining the blades preferred structure.

SUMMARY OF THE INVENTION

It is an object of the present invention to provide a hockey stick with a blade that prevents eye injuries and lacerations, or substantially reduces the risk thereof.

It is another object of the invention to provide a hockey stick blade having a soft upper tip for preventing eye injuries and lacerations, or substantially reducing the risk thereof.

It is also an object of the invention to provide a hockey stick blade that reduces the risk of injury while maintaining the overall structural dimensions and weight of the conventional hockey stick blade.

It is a further object of the invention to provide a device that can be attached to a conventional hockey stick blade easily and inexpensively without changing the overall size and weight of the stick.

In accordance with these and other objects, the present invention generally comprises a hockey stick having a blade with a soft, semi-rigid tip. The conventional hockey stick blade has a rigid front or toe edge with a generally sharp tip at the upper end thereof which is responsible for a significant number of injuries. The present invention reduces the risk of injury by providing a hockey stick blade with a tip comprising, preferably, a polyurethane foam tip cover adhered, molded or otherwise connected to the upper edge or tip of the toe without affecting the physical dimensions of the blade or interfering with the striking surface while still providing a softer, safer blade tip.

In one embodiment, the tip comprises a self-skinning, flexible, polyurethane foam that is adhered to a cutout or recessed section of the tip. A generally quarter-circular or corner cutout is defined by at least one side of the blade tip along the front edge of the tip to provide a thin recessed space relative to the rest of the blade for attaching the foam without deviating from the blade's desired thickness. Preferably, both sides of the blade tip and the front edge are recessed to allow placement of a substantial amount of foam material to maximize the resiliency of the tip while achieving some rigidity and surface area for adhering the foam. In addition, since the blade typically comprises fiberglass covering a wood laminate substrate, the cutout exposes the foam to wood, which is a more desirable surface for adhering the foam to because the foam, when applied, inhabits pores in the wood, providing a strong bond.

The tip is fabricated by first providing a cutout or recession in the blade tip and then setting a mold form around the blade tip. The foam may be comprised of isocyanate and a polymer resin, which are liquid in the pre-molded state so that they may be combined and poured into the mold. Once combined and poured, the two chemicals undergo a chemical reaction which causes the liquid foam to expand as it solidifies, locking the polyurethane foam into the wood pores of the blade. Alternatively, the polyurethane foam may be molded directly onto the fiberglass surface without making a cutout in the blade, whereby fiberglass is sufficiently porous for interlocking with the foam compound as it expands and solidifies. The resulting tip is only slightly thicker than the blade itself and, therefore, does not present a problem with control of the puck.

Further alternatively, the tip may comprise a semi-rigid rubber, such as a natural sponge rubber, adhered to the blade tip cutout or fiberglass surface. In this embodiment however, the rubber must usually be machine pressed into the blade tip to achieve the desired rubber density, and it may require additional adhesives.

BRIEF DESCRIPTION OF THE DRAWINGS

The invention is described in detail below with reference to the accompanying drawings, in which.

DESCRIPTION OF THE PREFERRED EMBODIMENTS

Figure 1:
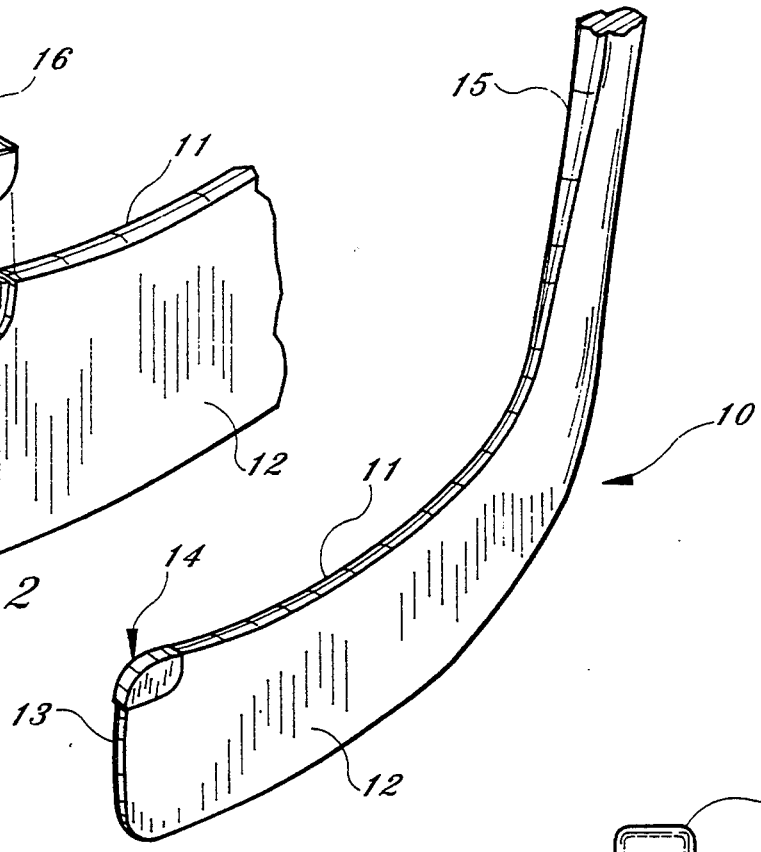
FIG. 1 is a perspective view of a preferred embodiment of the hockey stick blade of the present invention.

With reference to the drawings, FIGS. 1–5 depict a hockey stick blade 10 having a tip 14 for significantly reducing the number and severity of injuries to the eyes and face commonly caused by hockey stick blade tips. As seen in FIG. 1, the hockey stick blade 10 comprises a typical stick handle 15 with a blade 12 having a tip 14 between the top edge 11 and front edge or toe 13. The conventional hockey stick blade forms a rigid and sharp tip at the upper end of the toe where the top edge 11 and toe 13 meet at a corner. However, in the instant invention a protective tip 14 is permanently attached to that corner.

Figure 2:
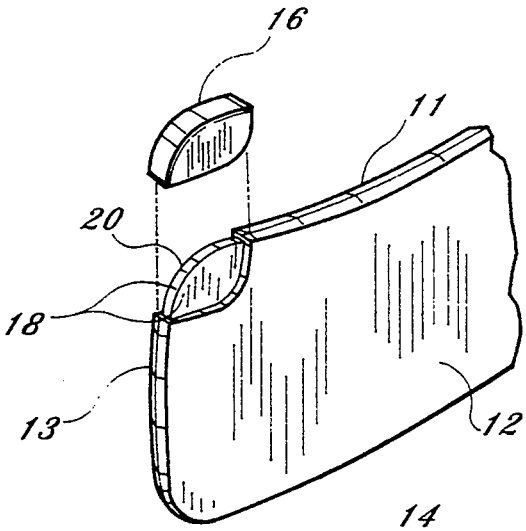
FIG. 2 is a partial perspective exploded cutaway view of the hockey stick blade slightly enlarged for clarity.
Figure 3:
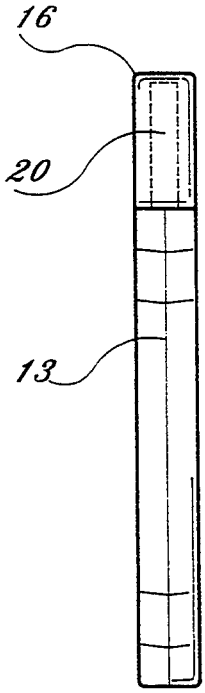
FIG. 3 is a front elevational view of the hockey stick blade illustrating the cutout in phantom and enlarged for clarity.

With reference to FIGS. 2 and 3, a first embodiment of the invention comprises a tip 14 having a recessed space or cutout 18, a polyurethane foam pad 16 and an interior blade tip 20. The common hockey stick blade is fabricated from a plurality of layers of wood laminated together, with a fiberglass layer covering the exterior. The recession 18 is defined by a corner cutout on both sides of the blade 12 from the top edge 11 to the toe 13. The cutout 18 reveals an interior blade tip 20 projecting from the cutout 18 which typically comprises the corner of the wooden frame. In lieu of a full cutout as shown, a groove or series of grooves may be employed, so long as an adequate surface profile results to "grab" protective member 16. The protective member or foam pad 16 comprises a semi-rigid polyurethane, preferably fabricated from a self-skinning, flexible, polyurethane foam that is adhered to the cutout 18 and interior tip 20 by an injection molding process to retain the overall shape and dimension of the blade 12 and tip 14. The foam is poured as a liquid into a mold (not shown) which defines the final shape of the tip 14. The foam eventually solidifies into the foam pad 16 as it simultaneously expands and locks into the wood pores of the interior blade tip 20.

As aforementioned the foam pad 16 preferably comprises a self-skinning, flexible, polyurethane foam which is liquid in the pre-molded state and poured into a mold where it solidifies. One benefit to the self-skinning, polyurethane foam is that its cells are internally disposed preventing the absorption of water such that the foam retains a soft, smooth exterior surface. The foam is comprised generally of two separate materials, isocyanate and a polymer resin, which circulate in a foam-circulating machine at temperatures between 60°–70° F. Once combined in the liquid state, the two liquids experience a chemical reaction which causes the combination to expand as it solidifies at room temperature. Polymer resin is mixed with isocyanate at a ratio of 100 parts per 24 parts, respectively, to obtain the desired foam resiliency. An increased level of isocyanate serves to enhance the rigidity of the foam and the rate of the reaction. Therefore, a delicate balance between the two chemicals is desired. It is also important to note that the density of the pad material should be maintained at a level that results in a semi-rigid foam having sufficient resiliency for absorbing impact. The polyurethane foam expands into the pores of the material to which it is applied after pouring so that it permanently adheres to the interior tip surface 20. This manufacturing process is desirous since the foam is fabricated without the use of freon, making it environmentally safe.

Figure 4:
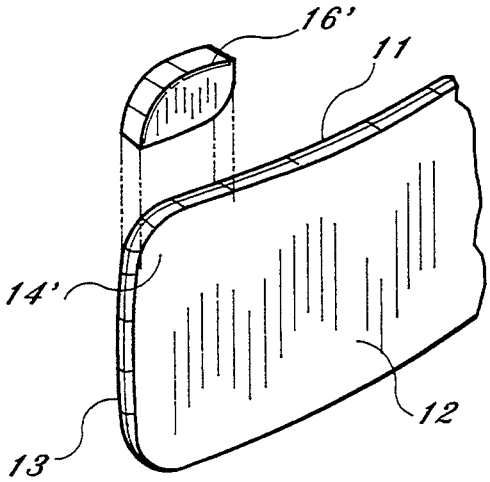
FIG. 4 is an exploded cutaway view of an alternate embodiment of the hockey stick blade.
Figure 5:
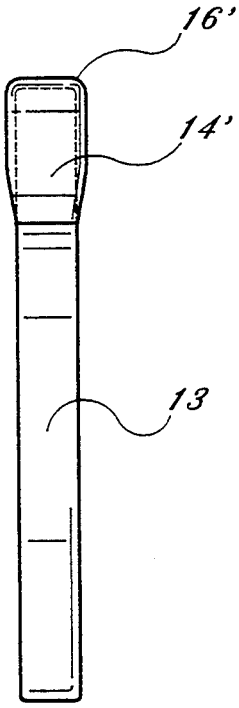
FIG. 5 is a front elevational view of the alternate embodiment of the hockey stick blade illustrating the blade tip in phantom and enlarged for clarity.

Alternatively, a polyurethane foam pad 16' may be molded directly onto the outer fiberglass covering of the stick, as illustrated in FIGS. 4 and 5, without providing a cutout in the blade as depicted in FIGS. 1–3. While fiberglass may be less porous than wood, it has been found to provide a suitable surface for interlocking with the foam compound as the foam expands and solidifies. This produces a tip 14' slightly thicker than the blade itself, as seen in FIG. 5, but only nominally so.

In an alternate embodiment, the pad 16 may be fabricated from a semi-rigid rubber, such as a natural sponge rubber, and adhered to the blade tip cutout 18 or fiberglass surface as previously discussed. The result would be as depicted in FIGS. 105. In this embodiment, however, the rubber must be machine pressed into the blade tip as the density necessary for a suitably rigid tip cannot be obtained using the type of molding discussed above. Furthermore, adhesives may be required for permanent attachment.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A method of permanently attaching a semi-rigid, self-skinning, polyurethane foam to the upper corner of the front edge of a hockey stick blade to construct a hockey stick blade, comprising the steps of:

(a) making a cutout in said upper corner of said blade;

(b) releasably attaching a mold framework to said blade around said upper corner;

(c) pouring said self-skinning, polyurethane foam in pre-molded liquid state into said mold;

(d) allowing said foam to solidify at room temperature, wherein it expands and locks into natural pores defined by said blade; and (e) removing said mold from said blade such that said solidified foam forms a resilient upper corner of said blade.

2. A method according to claim 1, further including the step of combining isocyanate and polymer resin at a predetermined ratio before pouring said foam into said mold as recited in step b.

3. A method according to claim 2, further including the step of circulating said isocyanate and said polymer resin in a foam circulating machine at temperatures between 60° and 70° Fahrenheit before said step of combining.

4. A hockey stick blade comprising:

a blade, said blade including a front edge, a top edge and front and back blade surfaces;

an upper corner defined between said front edge and said top edge, and a portion of each of said front and back blade surfaces;

at least one recess defined by a cutout in at least one of said blade surfaces extending from said front edge to said top edge, said cutout in at least one of said blade surfaces revealing an interior blade corner projecting from said cutout; and a flexible, resilient, foam pad integrally connected only to said upper corner, said foam pad generally occupying said recess and connected to said interior blade corner forming a resilient upper corner without generally altering the physical dimensions of the blade.

5. A hockey stick blade as recited in claim 4, wherein said foam pad is fabricated from a group of materials comprised of a semi-rigid, self skinning, polyurethane foam.

6. A hockey stick blade as recited in claim 5, wherein said foam includes isocyanate and polymer resin.

7. A hockey stick blade according to claim 4, wherein said foam comprises a water-resistant, semi-rigid, polyurethane foam.

8. A hockey stick blade comprising:

a blade, said blade having a front edge, a top edge and oppositely faced front and back blade surfaces;

an upper corner defined between said front edge and said top edge, and a portion of each of said front and back blade surfaces;

a recess defined by a cutout in each of said blade surfaces extending from said front edge to said top edge, said cutout in each of said blade surfaces revealing an interior blade corner projecting from said cutout; and a flexible, resilient, foam pad integrally connected only to said upper corner, said foam pad generally occupying said recess and connected to said interior blade corner forming a resilient upper corner without generally altering the physical dimensions of the blade.

9. A hockey stick blade according to claim 8, wherein said foam pad is fabricated from a group of materials comprised of a semi-rigid, self skinning, polyurethane foam.

10. A hockey stick blade according to claim 9, wherein said foam includes isocyanate and polymer resin.

11. A hockey stick blade according to claim 8, wherein said foam comprises a water-resistant, semi-rigid, polyurethane foam.

* * * * *